US005991580A

United States Patent [19]

Byeon

[11] Patent Number: 5,991,580

[45] Date of Patent: Nov. 23, 1999

[54] DEVELOPING UNIT OF MULTI-COLOR IMAGE FORMING DEVICE AND CONTROLLING METHOD THEREOF

[75] Inventor: Sang-Hyeon Byeon, Kyonggi-do, Rep. of Korea

[73] Assignee: SamSung Electronics Co., Ltd., Kyungki-do, Rep. of Korea

[21] Appl. No.: 09/097,674

[22] Filed: Jun. 16, 1998

[30] Foreign Application Priority Data

Jun. 19, 1997 [KR] Rep. of Korea ..... 97/24801

[51] Int. Cl.[6] ..... G03G 15/01

[52] U.S. Cl. ..... 399/227; 399/228

[58] Field of Search ..... 399/226, 227, 399/228, 223, 53

[56] References Cited

U.S. PATENT DOCUMENTS

| | | | |
|---|---|---|---|
| 4,713,673 | 12/1987 | Kessoku | 399/227 |
| 4,939,548 | 7/1990 | Yamada et al. | 399/226 |
| 5,294,967 | 3/1994 | Munakata et al. | 399/227 |
| 5,325,151 | 6/1994 | Kimura et al. | 399/227 |
| 5,440,373 | 8/1995 | Deki et al. . | |
| 5,486,902 | 1/1996 | Ito . | |
| 5,552,877 | 9/1996 | Ishikawa et al. . | |
| 5,585,598 | 12/1996 | Kasahara et al. . | |
| 5,600,431 | 2/1997 | Takeda et al. . | |
| 5,610,701 | 3/1997 | Terada et al. . | |
| 5,640,654 | 6/1997 | Yoshizawa . | |
| 5,666,613 | 9/1997 | Kumon et al. | 399/227 |
| 5,671,470 | 9/1997 | Maruta et al. . | |
| 5,724,634 | 3/1998 | Maruta . | |
| 5,752,141 | 5/1998 | Nishimura et al. . | |
| 5,758,235 | 5/1998 | Kosuge et al. . | |
| 5,761,576 | 6/1998 | Sugihara . | |
| 5,835,825 | 11/1998 | Maruta | 399/227 |

FOREIGN PATENT DOCUMENTS 62-148983 7/1987 Japan .

*Primary Examiner*—Susan S.Y. Lee
*Attorney, Agent, or Firm*—Robert E. Bushnell, Esq.

[57] ABSTRACT

A developing unit of a multi-color image forming device and a controlling method thereof employ a rotatable turret and a plurality of developers, each having a developing roller. The developer contacts a photosensitive drum only when a toner image is formed on the photosensitive drum by moving the developer radially to the rotary center of the turret using a developer transporting unit, such as a cylinder.

14 Claims, 7 Drawing Sheets

DEVELOPING UNIT OF MULTI-COLOR IMAGE FORMING DEVICE AND CONTROLLING METHOD THEREOF

CLAIM OF PRIORITY

This application makes reference to, incorporates the same herein, and claims all benefits accruing under 35 U.S.C. §119 from an application for DEVELOPING UNIT OF MULTI-COLOR IMAGE FORMING DEVICE AND CONTROLLING METHOD THEREOF earlier filed in the Korean Industrial Property Office on the 16th of Jun. 1997 and there duly assigned Ser. No. 24801/1997.

BACKGROUND OF THE INVENTION

1. Technical Field

The present invention relates to a developing unit of a multi-color image forming device, such as a color printer or a color copier, and more particularly to a developing unit of a multi-color image forming device and a controlling method thereof. The device and method provide the developing unit of the multi-color image forming device with a transporting unit for transporting a developer of the developing unit. The device and method also prevent vibration caused by the rotation of the developer and a photosensitive body by controlling the developer transporting unit, and remove the variation of the interval between the developer and the photosensitive body in the case of transfer.

2. Related Art

A multi-color image forming device comprises a printer, a copier or a scanner which can print an image composed of various colors (i.e., multi-colors) on a recordable medium. The multi-color image forming device includes: a paper feeding unit for feeding paper inside a case having a predetermined size; a charge unit for charging a transfer drum to adhere the fed paper to the transfer drum; a print unit which prints a predetermined image on the paper which is rotated as it adheres to the transfer drum, and which includes an exposing unit, a photosensitive drum and the developing unit; and a discharge unit for discharging the paper on which the printing operation is completed.

Typically, the developing unit has a plurality of developing rollers for spreading out the developing agent on an electrostatic latent image formed on the photosensitive drum. Moreover, in the developing unit, there are typically four developers corresponding to the four colors of developing agents employed. Typically, one of two types of arrangements for developing the developing agent are employed: a fixed type or a rotatable type. As stated in more detail below, the fixed type developing unit is burdened by the disadvantage that the cost of manufacturing the photosensitive drum (which must be quite large) is very high, and it is impossible to miniaturize the device. Therefore, the rotatable type developing unit is predominantly used.

However, the rotatable type developing unit is also burdened by the disadvantages. Specifically, as stated in more detail below, it has several problems since the developing roller is separated from the photosensitive drum by only a minute space, and since the turret employed therein is rotated by a mechanical driving device such as a motor.

Therefore, there is a need for the development of a developing unit and control method thereof which will effectively cope with the difference in the diameters of the developing rollers, and which will prevent the variation of space between the developing roller and the photosensitive drum when mechanical vibration of the turret occurs.

The following patents are considered to be representative of the prior art, and are burdened by the disadvantages set forth herein: U.S. Pat. No. 5,761,576 to Sugihara, entitled Image Forming Apparatus For Supplying Power To Members Of A Rotary Developing Device, U.S. Pat. No. 5,671,470 to Maruta et al., entitled Color Image Forming Device Which Changes Developing Bias When Switching Between Developer Units, U.S. Pat. No. 5,640,654 to Yoshizawa, entitled Color Image Forming Apparatus Having Rotary Developing Device, U.S. Pat. No. 5,610,701 to Terada et al., entitled Color Electrophotographic Apparatus And Image Forming Units Used Therein, U.S. Pat. No. 5,600,431 to Takeda et al., entitled Image Forming Apparatus For Forming Color Image With Dry Developer, U.S. Pat. No. 5,585,598 to Kasahara et al., entitled Rotary Developing Device For An Image Forming Apparatus, U.S. Pat. No. 5,552,877 to Ishikawa et al., entitled Image Forming Apparatus With Controlled Drive For Accurately Positioning Developing Sections of A Rotary Developing Device, U.S. Pat. No. 5,486,902 to Ito, entitled Color Image Forming Apparatus For Forming Color Image By Transferring Color Toner To Transfer Material, U.S. Pat. No. 5,758,235 to Kosuge et al., entitled Toner Container For A Rotary Developing Device, U.S. Pat. No. 5,440,373 to Deki et al., entitled Color Image Forming Apparatus, U.S. Pat. No. 5,724,634 to Maruta, entitled Image Forming Device In Which Developer Roller Speed Is Controlled In Developer Transfer To A Photoconductive Drum, and U.S. Pat. No. 5,752,141 to Nishimura et al, entitled Rotating Type Developing Apparatus.

SUMMARY OF THE INVENTION

Therefore, it is an object of the present invention to effectively cope with the difference in the diameters of developing rollers and to prevent the variation of space between the developing roller and a photosensitive drum when a mechanical vibration of a turret occurs.

According to one aspect of the present invention, a multi-color image forming device having a rotatable type turret and developers located in the turret includes a developer transporting unit for moving the developer radially to the rotary center of the turret.

Preferably, the developer transporting unit is a cylinder having one end fixed at the turret and the other end fixed at the developer, or a cam which is connected to a rotary shaft of the turret.

According to another aspect of the present invention, the developer contacts the photosensitive drum when the developing roller of the developer forms a toner image on the photosensitive drum.

Specifically, the turret including a plurality of developers, each equipped with a developing roller, is rotated when the developers are moved to the rotary center of the turret. When one of the developing rollers faces the photosensitive body, the turret stops and the developer moves so that the developing roller can contact the photosensitive body. After spreading a developing agent over the photosensitive body by rotating the developer and applying a high developing bias voltage, the rotation of the developer stops, and then the developer moves to the rotary center of the turret so that the developing roller can be withdrawn from the photosensitive body. The above operations are repeatedly performed with respect to each of the developers.

Preferably, the plurality of developers are four in number and containing colors of yellow, magenta, cyan and black, respectively.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood through the preferable embodiments referring to the attached drawings.

Figure 1:
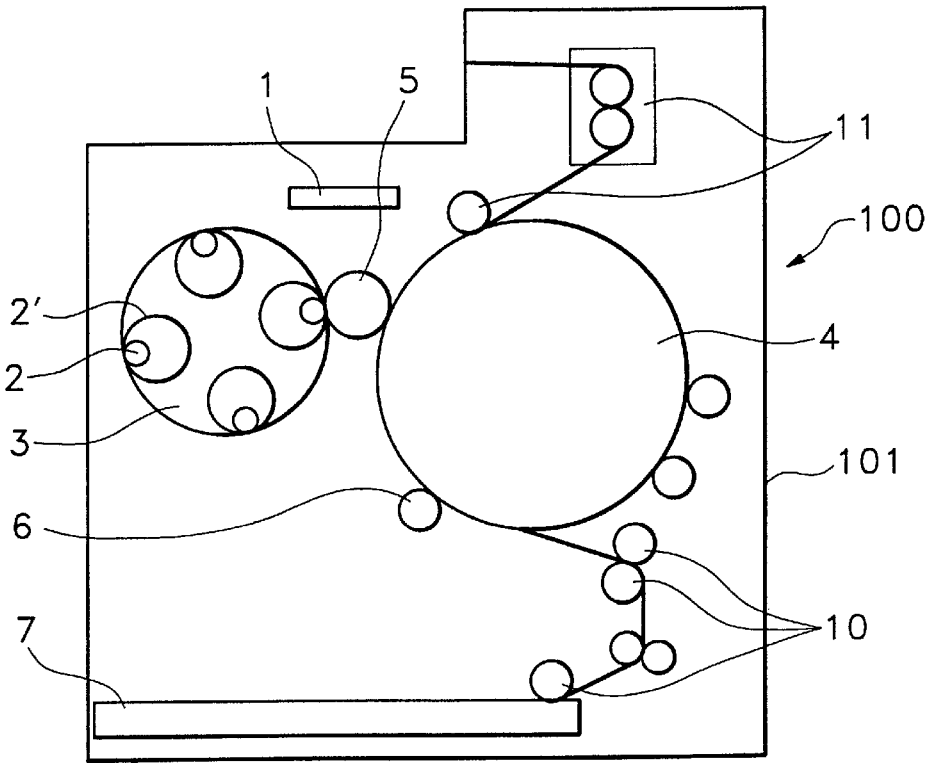
FIG. 1 is a view illustrating the structure of a multi-color image forming device.

FIG. 1 is a structural diagram illustrating the rough structure of a multi-color image forming device. As shown in the drawing, the paper feeding unit includes: a paper feeding cassette 7 which is located at the lower part of a housing 101 and stacks the paper; and a plurality of rollers 10 for drawing out the paper from one end of the paper feeding cassette 7 and transporting the paper.

The charge unit includes: the transfer drum 4 which is located at the upper part of the rollers 10 and which rotates adhering paper and supports the paper transported by the rollers 10 to its surface; and a charge roller 6 which is attached/detached to/from the surface of the transfer drum 4, and which charges the transfer drum 4 so that the paper can be adhered to the transfer drum 4.

The printing unit includes a photosensitive drum 5 which is located adjacent to the transfer drum 4 and which transfers a predetermined image onto the paper; an exposing unit 1 for forming an electrostatic latent image on the photosensitive drum 5; and a developing unit having a plurality of developing rollers 2 for spreading out a developing agent on the electrostatic latent image formed on the photosensitive drum 5.

In addition, the discharge unit includes a plurality of discharge rollers 11 which are located at the upper side of the printing unit and which discharge the paper on which the printing operation is completed. In a rotatable turret 3 of the developing unit, there are four developers 2' in which developing agents of four colors (such as yellow, magenta, cyan and black) are loaded, respectively.

In the above-described multi-color image forming device, there are two types of arrangements for developing the developing agent on the photosensitive drum: a fixed type and a rotatable type. The particular type depends on how the developing roller 2 of the developing unit is located around the photosensitive drum 5.

Figure 2:
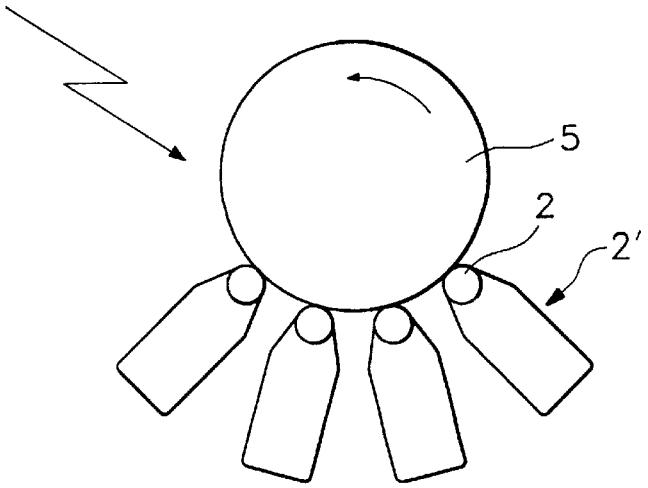
FIG. 2 is a view illustrating the structure of a fixed type developing unit of the multi-color image forming device.
Figure 3:
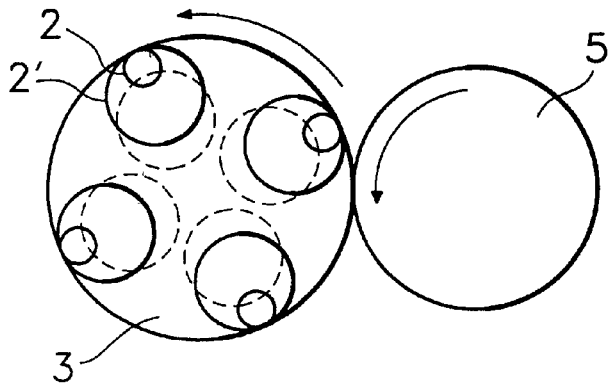
FIG. 3 is a view illustrating the structure of a rotatable type developing unit of the multi-color image forming device.

FIG. 2 is a view roughly illustrating the structure of the fixed type developing unit, and FIG. 3 is a view roughly illustrating the structure of the rotatable type developing unit.

Referring to FIG. 2, the fixed type developing unit includes the developing rollers 2 which are adjacent to the outer periphery of the photosensitive drum 5 and which are located at a predetermined area near the photosensitive drum 5. The outer periphery of each developing roller 2 maintains a predetermined distance with that of the photosensitive drum 5.

The developing roller 2 is received in a case having a predetermined shape for receiving component parts so as to supply developing agent to the developing roller 2.

In the fixed type developing unit, as the photosensitive drum 5 rotates, developing agent is supplied from each developing roller 2. When the electrostatic latent image is formed at a point indicated by the end of a bent arrow A shown in FIG. 2, the part where the electrostatic latent image is formed is rotated by a predetermined distance so as to maintain a proper state to receive the developing agent of desired color.

In the latter regard, the "predetermined distance" is a distance from the point where the electrostatic latent image is formed to the point where the developing agent is supplied (i.e., the part to be developed). Since the part where the electrostatic latent image is formed is predetermined and the parts to be developed are located at predetermined intervals, the predetermined distance is different for each part to be developed.

Due to the difference at each part to be developed, the electric potential of the part where the electrostatic latent image is formed varies for each part to be developed. Accordingly, the developing agent of each color is spread unevenly over the electrostatic latent image formed on the photosensitive drum 5, and the density of each color becomes uneven. In addition, due to the uneven density of the colors, blurring can occur in the printed image.

Moreover, in order to match the photosensitive drum to the fixed type developing unit equipped with three or four developers, the photosensitive drum should have a diameter capable of simultaneously locating three or four developers. The cost of manufacturing the photosensitive drum having such a large diameter is very high, and it is impossible to miniaturize the device.

Owing to the above problems, the rotatable type developing unit is mainly used. The structure of the rotatable type developing unit is as follows.

Referring to the rotatable type developing unit shown in FIG. 3, the rotatable turret 3 having a predetermined size is located near a part of the photosensitive drum 5. Three or four developers 2' are mounted on the turret 3, and the surface of the developing roller 2 of each developer 2' maintains a predetermined interval relative to the surface of the photosensitive drum 5.

The operation of the rotatable type developing unit having the above structure is explained as follows. After spreading the developing agent of a given color on the photosensitive drum 5, which is rotated and on which the electrostatic latent image is formed, when the turret 3 is rotated, a developing agent of another color to be developed (which is different from the color which is previously spread) is spread on the electrostatic latent image by rotating the developing roller 2 containing the latter developing agent toward the photosensitive drum 5.

Although the rotatable type developing unit solves certain problems (i.e., the variation of the electric potential of the electrostatic latent image and the size of the photosensitive drum), it has several problems since the developing roller is separated from the photosensitive drum by only a minute space, and since the turret is rotated by a mechanical driving device such as a motor.

First, as described above, the predetermined minute space is maintained between the developing roller and the photosensitive drum. In manufacturing three or four developing rollers, when the diameters of each of the developing rollers is different, different spaces are maintained between the surface of the photosensitive drum and the surfaces of each developing roller. Accordingly, the difference in spacing between each developing roller and the photosensitive drum causes the electric force by which the developing agent is adhered to the photosensitive drum to be uneven. Therefore, the amount of developing agent of each color spread over the photosensitive drum is different. As a result, when the image is printed, the developing densities of each color are different, and thereby a printed image of poor quality is obtained.

Second, since the turret is rotated by a mechanical driving device, such as a motor, a mechanical vibration is generated when operating or stopping the turret. Due to this mechanical vibration, a variation of spacing between the developing roller and the photosensitive drum is easily generated. Moreover, due to such an unstable developing operation, a poor image quality (such as a blurred image) is generated.

Figure 4:
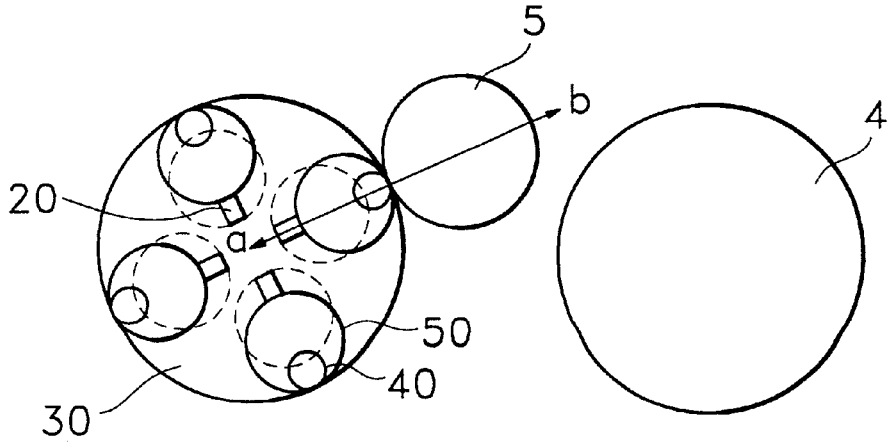
FIG. 4 is a view illustrating a turret equipped with developers of a multi-color image forming a device according to the present invention.
Figure 5A:
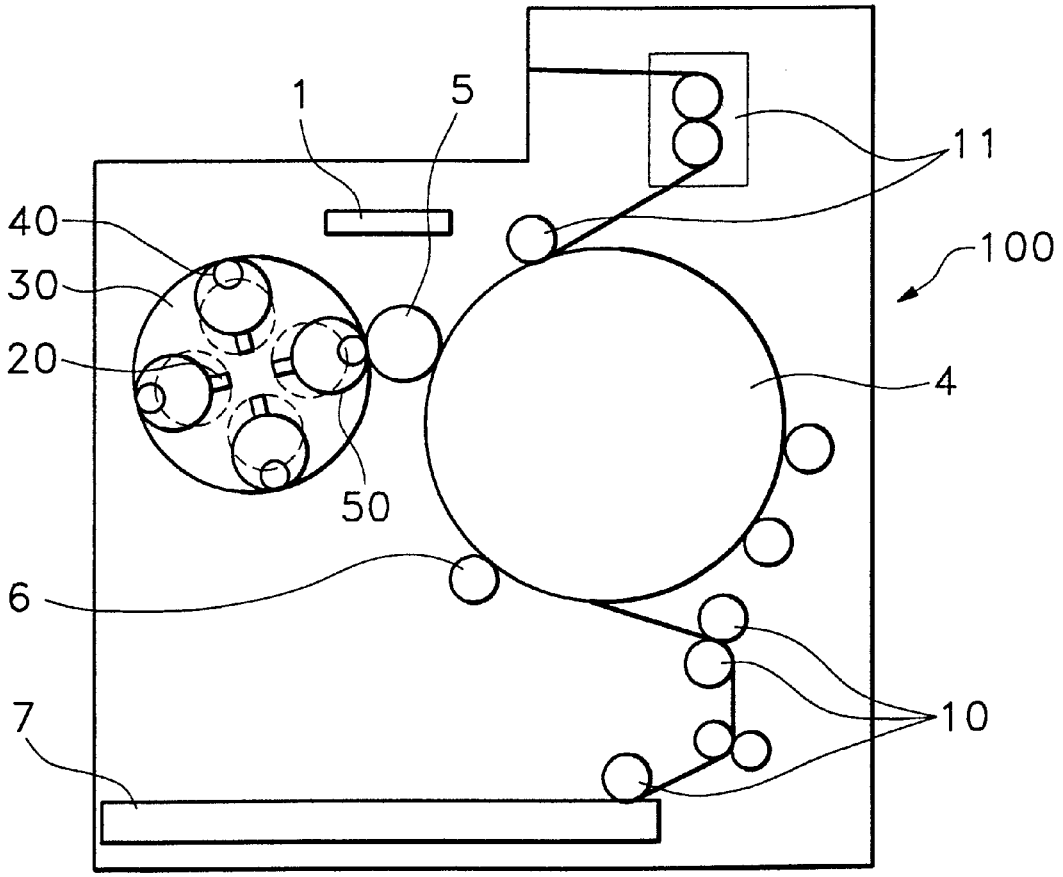
FIGS. 5A and 5B are views illustrating the multi-color image forming device employing a turret equipped with developers according to the present invention.
Figure 5B:
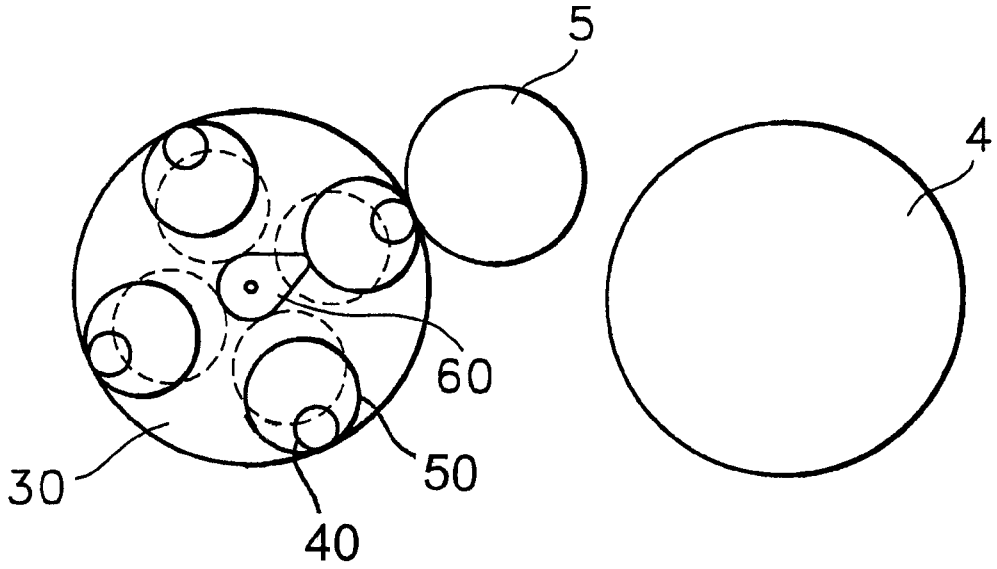

FIG. 4 is a view illustrating a turret equipped with developers of a multi-color image forming device; and FIGS. 5A and 5B are views illustrating the multi-color image forming device employing the turret equipped with developers according to the present invention.

Positions of each component part of the multi-color image forming device selected as one embodiment can vary according to the kind and size of the multi-color image forming device and other conditions.

Generally, the multi-color image forming device is a printer, a copier, or a scanner which can print an image composed of various colors (i.e., multi-colors) on a recordable medium. The multi-color image forming device 100 includes: a paper feeding unit 7 for feeding a paper inside a case having a predetermined size; a charge roller 6 for charging a transfer drum 4 so as to adhere the paper which is fed to the transfer drum 4; a print unit which prints a predetermined image on the paper which is rotated while adhered to the transfer drum 4, and which includes an exposing unit 1, a photosensitive drum 5 and a developing unit; and a discharge unit for discharging the paper on which the printing operation is completed by the printing unit.

The developing unit is designed to spread a developing agent over the photosensitive drum 5 on which a latent image is formed by the exposing unit 1. In a rotatable turret 30, four developers 50 having four colors, such as yellow, magenta, cyan and black, are received.

According to the present invention, a developer transporting unit 20 is mounted between the turret 30 and each of the developers 50. As indicated with dotted lines in FIG. 4, the developer transporting units 20 are established so that each of the developers 50 cannot contact each other when the developers 50 move to the center of the turret 30. The developer 50 is a unit including developing rollers 40, a toner loading unit (not shown) and a housing (not shown).

In addition, the developer transporting unit 20 has one end fixed at the turret 30 and the other end fixed at the developer 50. The developer transporting unit 20 can use an air pressure cylinder or a hydraulic cylinder, and it is also possible to use a motor or another driving unit. In addition, it is possible to move the developer 50 using a cam 60 fixed to the rotary shaft of the turret 30.

The position for mounting the developer transporting unit 20 is decided by the allowable difference in the diameter of the developing roller 40 of the developer 50. The mounting position is determined such that each of the developing rollers 40 can have the same traveling section, and it is preferable to contact the surface of the photosensitive drum 5 with each of the developing rollers 40.

Hereinafter, the operation of the developing unit of the multi-color image forming device according to the present invention will be explained with reference to the drawings.

FIGS. 6A to 6H are timing diagrams illustrating periods in which the operation of each component part starts and ends when the multi-color image forming device is operated.

Referring to FIG. 5A, a paper which is set in the paper feeding cassette 7 moves by a plurality of paper feeding rollers 10 and contacts the transfer drum 4, and then adheres to the surface of the transfer drum 4 by an electrostatic force caused by the charge roller 6.

The paper adhered to the transfer drum 4 is rotated with the transfer drum 4, and then contacts the photosensitive drum 5. At this time, the toner image formed on the surface of the photosensitive drum 5 is transferred onto the paper.

The process of forming the toner image on the photosensitive drum 5 is explained. An electric signal reading a predetermined image is inputted to an optical system of the exposing unit 1. By transmitting a laser beam to the photosensitive drum 5 which is rotated according to the inputted signal, the electrostatic latent image is formed. When the photosensitive drum 5 rotates and arrives at a part where a predetermined interval is maintained with the developing roller 40, the developing agent supplied to the surface of the developing roller 40 is spread on the electrostatic latent image formed on the photosensitive drum 5, and thereby the toner image is formed. The paper on which the toner image is printed is discharged from the device by a plurality of discharge rollers 11.

According to the present invention, at the transfer step, the paper on which one color is printed by one developing roller 40 out of a plurality of developing rollers 40 is rotated while adhered to the transfer drum 4 through the discharge roller 11. The turret 30 of the developing unit is rotated by a predetermined angle before the paper arrives at the photosensitive drum 5. Subsequently, the operation of transferring a second color is performed by next contacting the developing roller 40 having a color to be printed with the photosensitive drum 5.

The above transfer operation is performed three or four times according to the number of colors to be printed, thereby forming the multi-color image on the paper.

Referring to FIGS. 6A to 6H, the periods in which each component part operates and stops are explained.

Figures 6A, 6B, 6C, 6D, 6E, 6F, 6G, 6H:
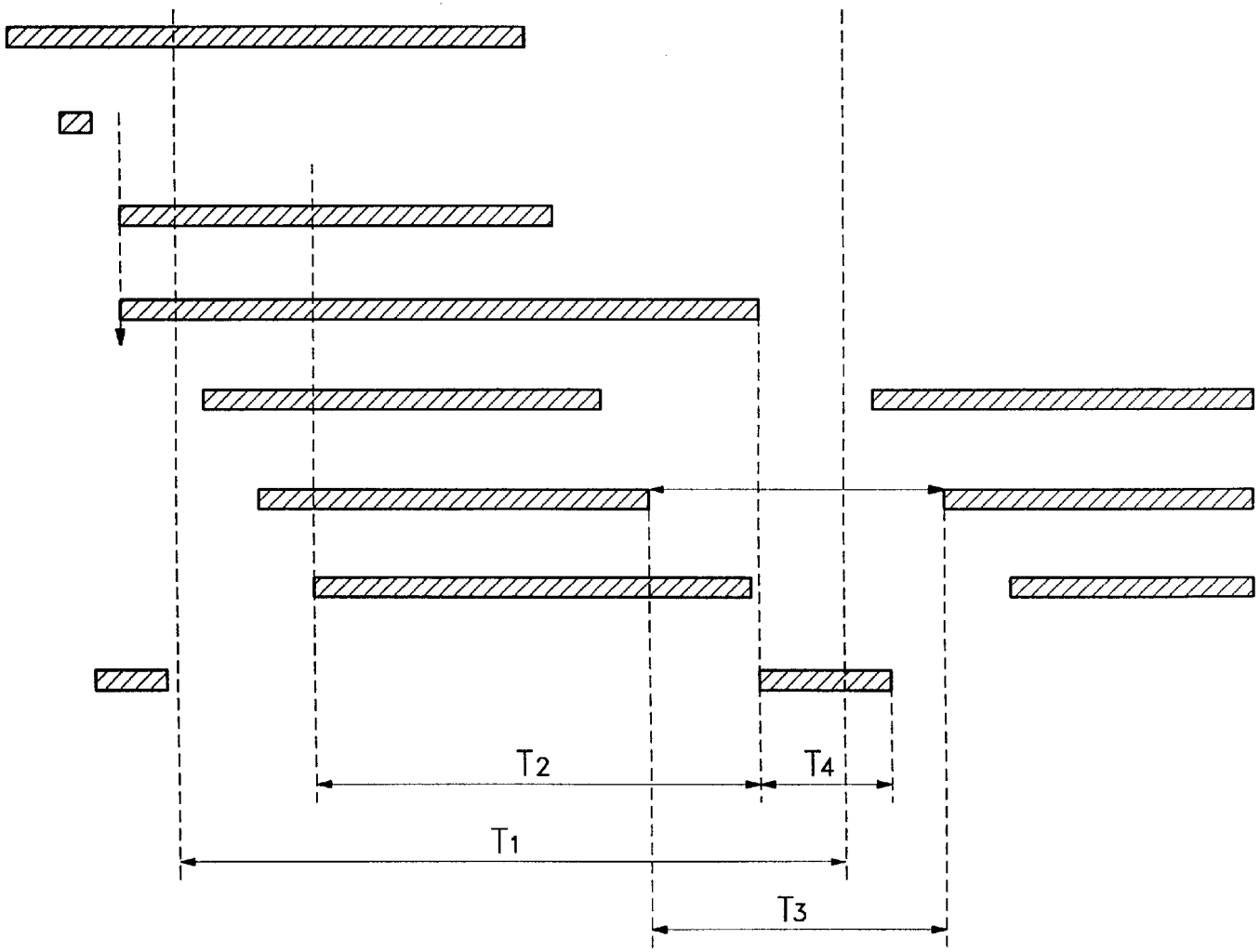
FIGS. 6A to 6H are timing diagrams illustrating periods in which each component part of the multi-color image forming device according to the present invention is operated.

FIG. 6A indicates a period for feeding the paper; FIG. 6B is a period for adhering the paper to the transfer drum; FIG. 6C is a period for supplying a high charge voltage to the charge roller 6 in order to adhere the paper to the charge roller 6; and FIG. 6D is a period in which the charge roller 6 to which the high charge voltage is applied is operated.

In addition, FIG. 6E is an exposure period for forming the electrostatic latent image on the photosensitive drum 5; FIG.

6F is a developing period for spreading the developing agent on the electrostatic latent image formed on the photosensitive drum 5; FIG. 6G is a transfer period for transferring the developing agent, which is spread on the electrostatic latent image with a predetermined shape, onto the paper; and FIG. 6H is a period in which the turret 30 is rotated for the next developing operation.

Time T1 illustrated in the drawings indicates a period for preparing to transfer the next color by adhering the paper to the charge roller 6 and rotating them after one color image is transferred onto the paper when the paper is fed; and time T2 indicates a period for printing a predetermined image onto the paper. During the transfer operation, the exposure operation for forming the electrostatic latent image on the photosensitive drum 5 and the developing operation for spreading the developing agent on the electrostatic latent image are continuously performed.

Time T3 is a main part of the present invention indicating a period between the first developing operation and the second developing operation. In other words, T3 indicates a period for withdrawing the developing roller 40 from the photosensitive drum 5 by operating the developer transporting unit 20. Accordingly, T3 includes T4 which indicates a period in which the turret 30 equipped with the developing rollers is rotated.

Out of the above-described operations of the multi-color image forming device, FIG. 6F relates to the developing operation.

Figure 7A:
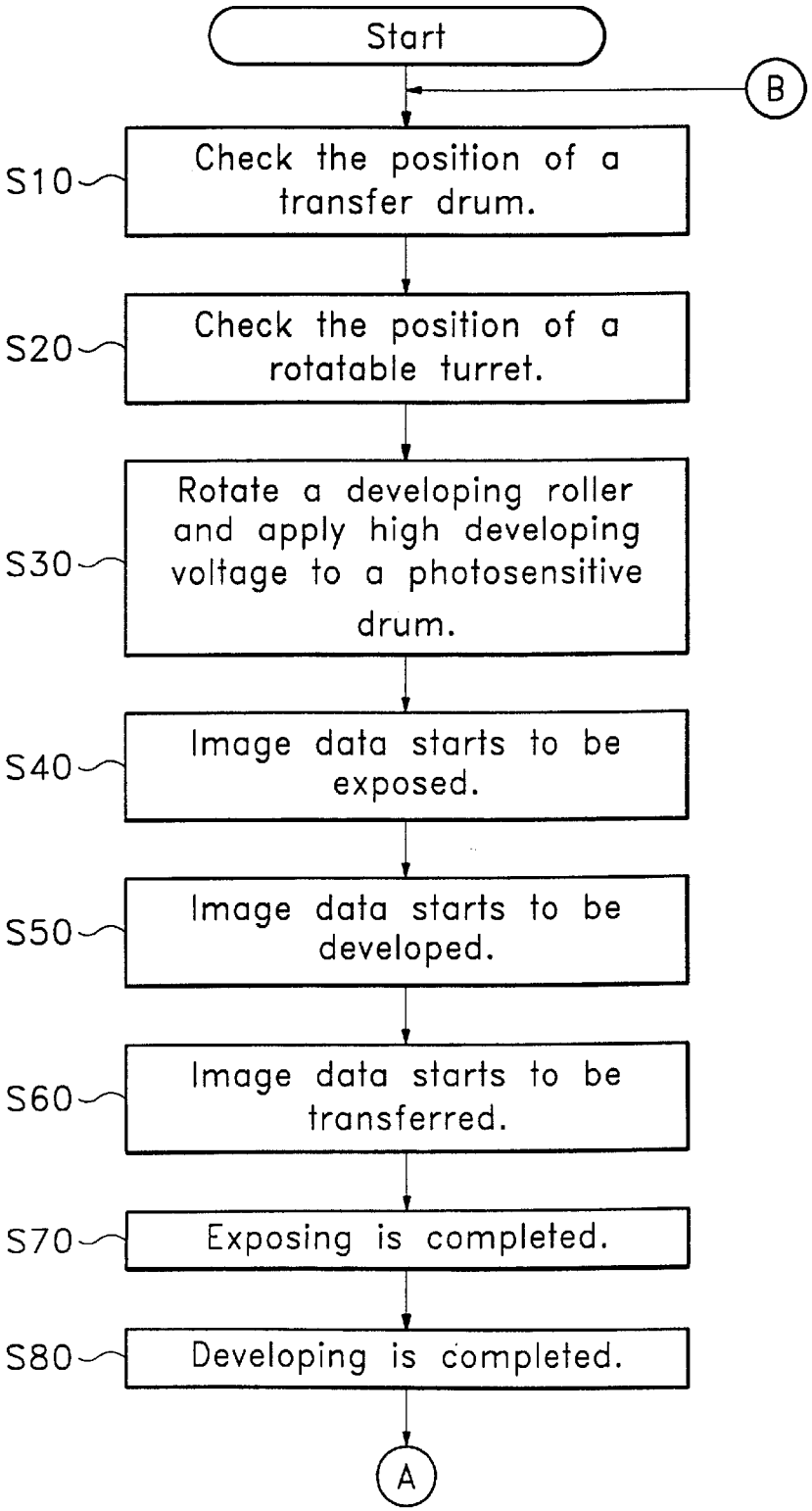
FIGS. 7A and 7B are a flowchart illustrating a printing operation of the multi-color image forming device employing the turret equipped with developers according to the present invention.
Figure 7B:
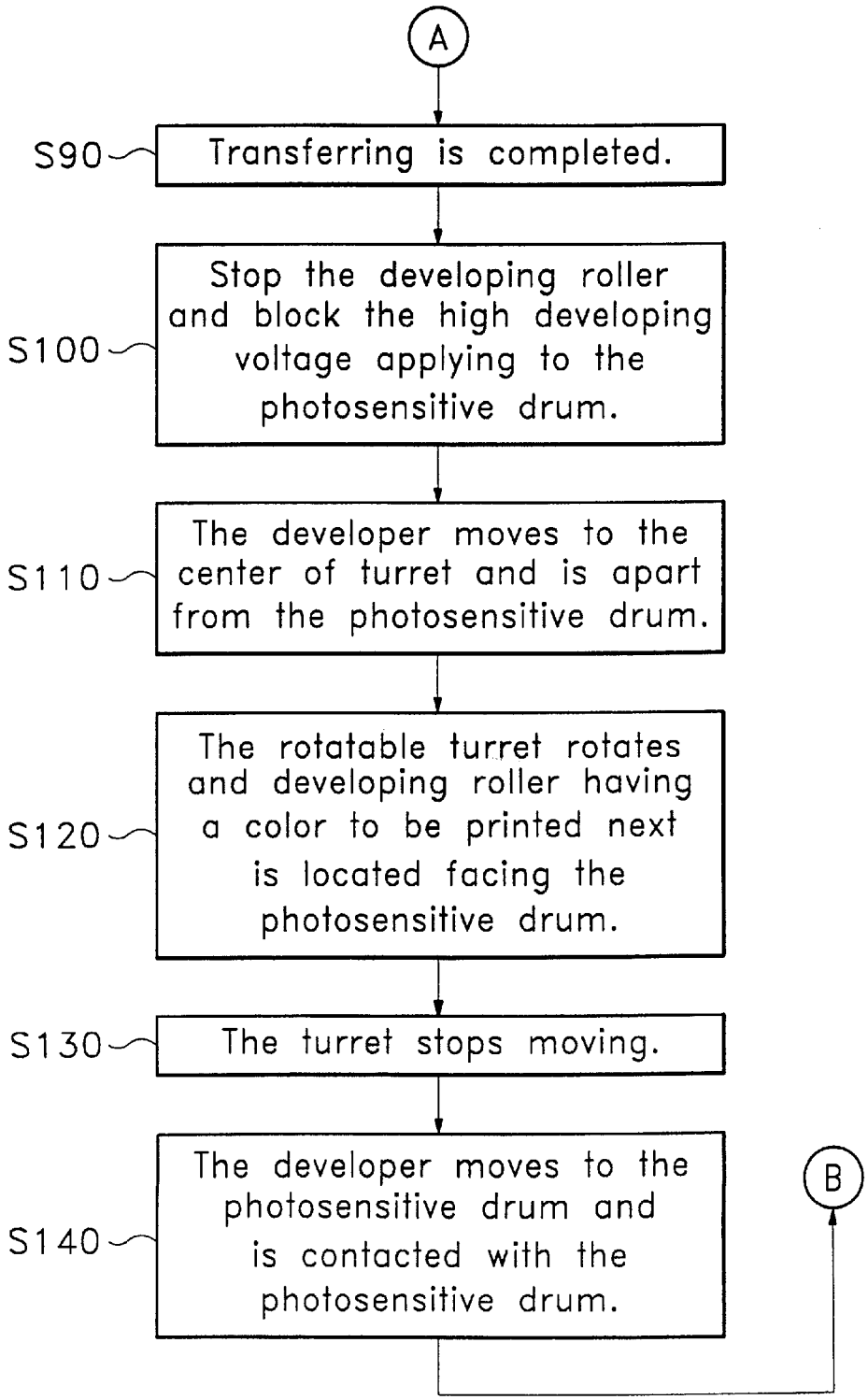

Hereinafter, the developing operation is explained in detail with reference to FIGS. 7A and 7B. FIGS. 7A and 7B are a flowchart illustrating the process of the transfer operation of the multi-color image forming device.

As shown in the drawing, the paper passes through the paper feeding roller 10 and is adhered to the surface of the transfer drum 4. After the paper moves to a position near the photosensitive drum 5, it is determined whether the transfer drum 4 is operating at a proper position (step 10). In addition, it is determined whether the turret 30 equipped with the developing roller 40 has stopped at a proper position (step 20).

At steps 10 and 20, if the transfer drum 4 and the turret 30 are not fixed at proper respective positions, proper positions are set to fix them.

When the transfer drum 4 and the turret 30 are fixed at proper positions, the developing roller 40 on which the developing agent is spread is rotated and a predetermined voltage (i.e., a high developing voltage) is applied to the photosensitive drum 5 in order to form the latent image (step 30).

Subsequently, when the optical system of the exposing unit I radiates the laser beam onto the surface of the photosensitive drum 5 to which the high developing voltage is applied, the electrostatic latent image is formed (step 40).

At step 40, the electrostatic latent image is formed on the surface of the photosensitive drum 5 when the photosensitive drum 5 rotates. When the photosensitive drum 5 rotates and the electrostatic latent image passes through the developing roller 40, the developing agent spread on the surface of the developing roller 40 forms the latent image (step 50).

The developing agent which is spread as described is transferred onto the paper when the photosensitive drum 5 rotates and passes through the paper which is rotated and adhered to the surface of the transfer drum 4 (step 60).

When one color among the colors to be printed is completely transferred onto one paper at step 60, the exposing, developing and transferring operations are successively completed (steps 70, 80 and 90). Afterwards, the operation of the developing roller 40 stops, and the high developing voltage applied to the photosensitive drum 5 is blocked (step 100).

For printing the next color, the developing roller 40 moves to the center of the turret 30 (i.e., in the 'a' direction of FIG. 4), and the photosensitive drum 5 and the developing roller 40 do not interfere with each other. (Step 110).

After that, by rotating the turret 30, the developing roller 40 (on the surface of which the developing agent for the color to be printed is spread) is located to face the photosensitive drum 5 (step 120). When the developing roller 40 arrives at the desired position, the turret 30 stops moving (step 130).

Subsequently, by moving the developer 50 to the photosensitive drum 5 (i.e., in the 'b' direction of FIG. 4), the surface of the photosensitive drum 5 and the surface of the developing roller 40 contact each other (step 140). After performing step 140, the operation is repeatedly performed by returning to step 10.

The above operation is repeatedly performed three times when the number of colors to be printed are three, and is performed four times when the number of colors are four. After performing steps 10 to 140, the printed paper is discharged from the device.

As described above, by employing the developer transporting unit so that the developing roller of the developer can move toward the center of the turret, the change in the interval between the developing roller and the photosensitive drum is eliminated in performing the developing operation, even if the diameters of the developing rollers are differently formed in manufacturing the developing roller or by shock from the outside. In addition, by moving the developer toward the center of the turret when rotating the turret, variation in the position of the photosensitive drum and the interval between the photosensitive drum and the developing roller can be prevented.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A developing unit for a multi-color image forming device, said unit comprising:

a rotatable turret having a rotary center;

a plurality of developers received in said turret; and developer transporting means for moving said developers radially to the rotary center of said turret;

wherein said unit includes a rotary shaft of said turret, and said developer transporting means comprises a cam fixed to said rotary shaft of said turret.

2. The developing unit of claim 1, wherein said developer transporting means comprises a plurality of cylinders, each said cylinder having one end fixed at said turret and another end fixed at a respective one of said developers.

3. A method for controlling a developing unit of a multi-color image forming device which forms a toner image at a photosensitive drum, said method comprising:

providing said developing unit with a plurality of developers received by a turret, each of said developers including a developing roller;

rotating said turret to move one of said developers into a position to contact said photosensitive drum;

rotating the developing roller of said one of said developers and applying a developing voltage to said photosensitive drum so as to form an image on said photosensitive drum; and stopping said developing roller of said one of said developers and blocking said developing voltage when said image is formed on said photosensitive drum;

said method further comprising the steps of moving said one of said developers to a rotary center of said turret in order for said developing roller of said one of said developers to be withdrawn from said photosensitive drum.

4. The method of claim 4, further comprising:

applying the developing voltage; and after the step of rotating said developing roller, spreading a developing agent on said photosensitive drum.

5. A method for controlling a developing unit of a multi-color image forming device, comprising the steps of:

rotating a turret in which a plurality of developers, each equipped with a developing roller, is received;

stopping said turret and moving one of said developing rollers into contact with a photosensitive body when said one of said developing rollers faces said photosensitive body;

spreading a developing agent on said photosensitive body by rotating said one of said developing rollers and applying a developing voltage thereto;

stopping rotation of said one of said developing rollers and blocking said developing voltage; and repeatedly performing said above steps for a remainder of said developing rollers;

said method further comprising the step, after the step of stopping rotation of said one of said developing rollers, of moving said one of said developing rollers to a rotary center of said turret in order for said one of said developing rollers to be withdrawn from said photosensitive body.

6. The method of claim 5, wherein said plurality of developers include developers for yellow, magenta, cyan and black colors.

7. A method of controlling a developing unit of a multi-color image forming device which forms a toner image on a photosensitive drum, said method comprising:

providing said developing unit with at least one developer received by a turret, each said at least one developer including a developing roller;

rotating said developing roller and applying a high developing voltage to said photosensitive drum;

stopping the developing roller and blocking the high developing voltage; and moving said developer to a center of said turret separated from said photosensitive drum.

8. The method of claim 7, wherein said at least one developer comprises a plurality of developers, said method further comprising the steps of:

rotating a further one of said developing rollers having a color to be printed next into a position facing said photosensitive drum;

stopping turret;

moving said further one of said developers to a position in contact with said photosensitive drum; and repeating said above steps for said further one of said developers.

9. A developing unit for a multi-color image forming device, said unit comprising:

a rotatable turret having a rotary center;

a plurality of developers received in said turret; and developer transporting means for moving said developers radially to the rotary center of said turret;

wherein said developer transporting means comprises a plurality of cylinders, each cylinder extending axially between said rotary center of said turret and a respective one of said developers, said each cylinder having one end fixed at said rotary center of said turret and another end fixed to said respective one of said developers.

10. The developing unit of claim 9, wherein said each cylinder is driven in a first axial direction to urge said respective one of said developers toward a photosensitive drum, and is driven in a second axial direction to withdraw said respective one of said developers from said photosensitive drum.

11. The developing unit of claim 9, wherein a developing agent is spread on a photosensitive drum and a developing voltage is applied to said photosensitive drum when said respective one of said developers is in contact with said photosensitive drum.

12. The developing unit of claim 9, wherein each said developer comprises a developing roller which is rotated in contact with a photosensitive drum at the same time that a developing voltage is applied to said photosensitive drum; and wherein rotation of said developing roller is stopped and said developing voltage is blocked at the end of a developing process.

13. The developing unit of claim 9, wherein said rotatable turret is rotated in order to move one of said developers into a position adjacent to a photosensitive drum, and said developer transporting means moves said one of said developers into contact with said photosensitive drum.

14. The developing unit of claim 13, wherein said developer transporting means withdraws said one of said developers from said photosensitive drum after a developing process has been completed.

* * * * *